US009206007B2

(12) United States Patent
Helseth et al.

(10) Patent No.: US 9,206,007 B2
(45) Date of Patent: Dec. 8, 2015

(54) BAG DISPENSER

(75) Inventors: James Ray Helseth, Plymouth, MN (US); Ralph Paul Stillman, Excelsior, MN (US)

(73) Assignee: Twist-Ease Inc., Minneapolis, MN (US)

( * ) Notice: Subject to any disclaimer, the term of this patent is extended or adjusted under 35 U.S.C. 154(b) by 464 days.

(21) Appl. No.: 13/485,438

(22) Filed: May 31, 2012

(65) Prior Publication Data

US 2013/0134181 A1 May 30, 2013

Related U.S. Application Data

(60) Provisional application No. 61/491,692, filed on May 31, 2011.

(51) Int. Cl.

| | |
|---|---|
| ***B65H 16/00*** | (2006.01) |
| ***B65H 35/10*** | (2006.01) |
| *A47F 9/04* | (2006.01) |

(52) U.S. Cl.

CPC ..... *B65H 16/005* (2013.01); *B65H 35/10* (2013.01); *A47F 2009/044* (2013.01); *Y10T 83/896* (2015.04); *Y10T 225/241* (2015.04)

(58) Field of Classification Search

CPC ..... B65H 16/00; B65H 16/02; B65H 16/06; B65H 18/02; B65H 18/28; B65H 35/00; B65H 35/002; B26F 3/00; B26F 3/002; Y10T 225/20; Y10T 225/238; Y10T 225/241; Y10T 225/246; Y10T 225/247; Y10T 225/287; Y10T 225/393; Y10T 83/889; Y10T 83/896

USPC ..... 225/6, 39, 42, 46, 47, 82, 106; 242/159, 242/106.3, 176–178, 410, 422.4, 422.5, 242/423; 206/389; 83/648, 649

See application file for complete search history.

(56) References Cited

U.S. PATENT DOCUMENTS

| | | | |
|---|---|---|---|
| 1,055,639 | A | 3/1913 | Juengst |
| 1,778,282 | A | 10/1930 | Stewart |
| 3,126,122 | A | 3/1964 | Sacre |
| 3,193,070 | A | 7/1965 | Dudenhoffer |
| 3,220,605 | A | 11/1965 | Casey |
| 3,346,725 | A | 10/1967 | Allured et al. |
| 3,416,705 | A | 12/1968 | Hohmann |
| 3,545,742 | A | 12/1970 | Muller et al. |
| 3,756,586 | A | 9/1973 | Craft |
| 3,858,797 | A | 1/1975 | Takeuchi |
| 3,899,841 | A | 8/1975 | Berger |
| 3,902,713 | A | 9/1975 | Von Lühmann et al. |
| 3,936,041 | A | 2/1976 | Shiina et al. |

(Continued)

FOREIGN PATENT DOCUMENTS

| | | |
|---|---|---|
| JP | I-317923 | 12/1989 |

*Primary Examiner* — Phong Nguyen

(74) *Attorney, Agent, or Firm* — Merchant & Gould P.C.

(57) ABSTRACT

A bag dispenser includes a frame with a roller portion for receiving a bag roll defined by a plurality of bags attached to a leading bag to be dispensed, the roller defining a longitudinal axis. A brake plate is configured to capture the leading bag against the frame for providing frictional force on the leading bag to limit sliding thereof, the brake plate pivotally attached to the frame via a pivot arm, the brake plate pivotable with respect to the frame between a non-pivoted friction-application position and a pivoted bag roll-installment position, the pivot arm configured to pivot with respect to the frame along a pivot plane generally perpendicular to the longitudinal axis.

16 Claims, 13 Drawing Sheets

(56) References Cited

U.S. PATENT DOCUMENTS

| | | | | |
|---|---|---|---|---|
| 3,970,298 | A | | 7/1976 | Irvine et al. |
| 4,026,436 | A | | 5/1977 | Madsen |
| 4,039,181 | A | | 8/1977 | Prewer |
| 4,275,874 | A | | 6/1981 | DiBlasio |
| 4,436,298 | A | | 3/1984 | Donner et al. |
| 4,437,656 | A | | 3/1984 | Onoda et al. |
| 4,461,466 | A | | 7/1984 | Uchida et al. |
| 4,475,732 | A | | 10/1984 | Clausing et al. |
| 4,480,824 | A | | 11/1984 | Acquaviva |
| 4,519,600 | A | | 5/1985 | Warwick et al. |
| 4,530,200 | A | | 7/1985 | Prewer |
| 4,548,397 | A | | 10/1985 | Rünzi |
| 4,565,361 | A | | 1/1986 | Tanaka et al. |
| 4,651,982 | A | | 3/1987 | Martin |
| 4,690,303 | A | | 9/1987 | Draper et al. |
| 4,717,043 | A | | 1/1988 | Groover et al. |
| 4,840,290 | A | | 6/1989 | Nakamura et al. |
| 4,875,599 | A | | 10/1989 | Tuttle et al. |
| 4,919,412 | A | | 4/1990 | Weigel et al. |
| 5,083,765 | A | | 1/1992 | Kringel |
| 5,135,146 | A | | 8/1992 | Simhaee |
| 5,207,349 | A | | 5/1993 | Kringel |
| 5,261,585 | A | | 11/1993 | Simhaee |
| 5,433,363 | A | | 7/1995 | Simhaee |
| 5,558,262 | A | * | 9/1996 | Simhaee ..... 225/106 |
| 5,934,535 | A | | 8/1999 | Kannankeril et al. |
| 6,199,788 | B1 | * | 3/2001 | Simhaee ..... 242/422.5 |
| 6,279,806 | B1 | | 8/2001 | Simhaee |
| 6,685,075 | B1 | * | 2/2004 | Kannankeril ..... 225/96 |
| 7,270,256 | B2 | | 9/2007 | Daniels |
| 7,530,526 | B1 | * | 5/2009 | Powers ..... 242/598.5 |
| 2007/0039991 | A1 | * | 2/2007 | Alberts ..... 225/46 |
| 2009/0008422 | A1 | * | 1/2009 | Daniels ..... 225/46 |
| 2011/0073629 | A1 | * | 3/2011 | Tseng ..... 225/51 |
| 2012/0125970 | A1 | * | 5/2012 | Tsui ..... 225/106 |

* cited by examiner

BAG DISPENSER

CROSS REFERENCE TO RELATED APPLICATION

This application claims the benefit of U.S. Provisional Patent Application Ser. No. 61/491,692, filed May 31, 2011, which application is hereby incorporated by reference in its entirety.

FIELD

The present disclosure generally relates to bag dispensers used by consumers in grocery stores for bagging items such as produce, confectionary, etc. More specifically, the present disclosure relates to a type of bag dispenser that is configured or easily configurable to be able to be used with bags made by various different manufacturers.

BACKGROUND

Generally, bag dispensers available to consumers in grocery stores for items such as produce, confectionary, etc. are tailored to bags made by a particular manufacturer. Once the manufacturer or the brand of bag is decided upon, the bag dispensers are customized for that particular brand or manufacturer and generally become permanent fixtures in the stores. If the brand or manufacturer is changed, the bag dispensers have to be replaced or modified to be able to be used with the incoming brand. What is needed in the art is a type of bag dispenser that can accommodate different brands/types of bags or one which is easily modifiable to do so.

SUMMARY

The present disclosure relates generally to a bag dispenser that is configured or easily configurable to be able to be used with bags made by various different manufacturers.

According to one example aspect, the bag dispenser includes a roller for mounting a bag roll that is configured for use with a variety of different bag rolls having a variety of different core diameters.

According to another example aspect, the bag dispenser includes a first braking arrangement for providing a frictional force on a leading bag in a roll when a consumer pulls the leading bag to facilitate tearing of the bag at the tear line, the first braking arrangement being of the type that may be configured to be used with different brands, types, materials, or thicknesses of bags. The bag dispenser also includes a second braking arrangement to prevent freewheeling of the bag roll when a consumer pulls and tears the leading bag, the second braking arrangement being of the type that may be used with a variety of different bag rolls having a variety of different core diameters.

According to another example aspect, the bag dispenser includes a frame with a roller portion for receiving a bag roll defined by a plurality of bags attached to a leading bag to be dispensed, the roller defining a longitudinal axis. A brake plate is configured to capture the leading bag against the frame for providing frictional force on the leading bag to limit sliding thereof, the brake plate pivotally attached to the frame via a pivot arm, the brake plate pivotable with respect to the frame between a non-pivoted friction-application position and a pivoted bag roll-installment position, the pivot arm configured to pivot with respect to the frame along a pivot plane generally perpendicular to the longitudinal axis.

According to another example aspect, the bag dispenser includes an interchangeable tongue structure that has a pincher/perforator, wherein the tongue structure can be removed and replaced by a different one depending upon the type or brand of bag used.

According to another example aspect, the bag dispenser includes a type of accessory mount for mounting various different types of structures such as twist-tie dispensers or other accessory holders adjacent the bag dispenser.

According to another example aspect, the bag dispenser includes a dispenser support that allows the bag dispenser to pivot along a plane generally parallel to a ground surface on which the dispenser support is mounted, allowing a consumer to be able to pull the leading bag at angles other than parallel to the dispensing direction.

According to another example aspect, the pivoting structure provided on the dispenser support is a self-centering structure that guides the frame of the bag dispenser to return to the original position before the pivot action.

According to another example aspect, the bag dispenser includes a frame with a roller portion for receiving a bag roll defined by a plurality of bags attached to a leading bag to be dispensed, the roller defining a longitudinal axis. A dispenser support mounts the frame on a mounting surface, the dispenser support defining a base configured to be mounted to the mounting surface, a first post attached to the base and a second post attached to the frame, the second post being at least partially rotatable with respect to the first post for allowing the frame to pivot with respect to the mounting surface along a plane including the longitudinal axis of the roller, one of the first post and the second post defining a generally V-shaped self-centering groove configured to receive a pin of the other of the first post and the second post.

BRIEF DESCRIPTION OF THE DRAWINGS

The accompanying drawings, which are incorporated in and constitute a part of the description, illustrate several aspects of the inventive features and together with the detailed description, serve to explain the principles of the disclosure. A brief description of the drawings is as follows.

DETAILED DESCRIPTION

Figure 1:
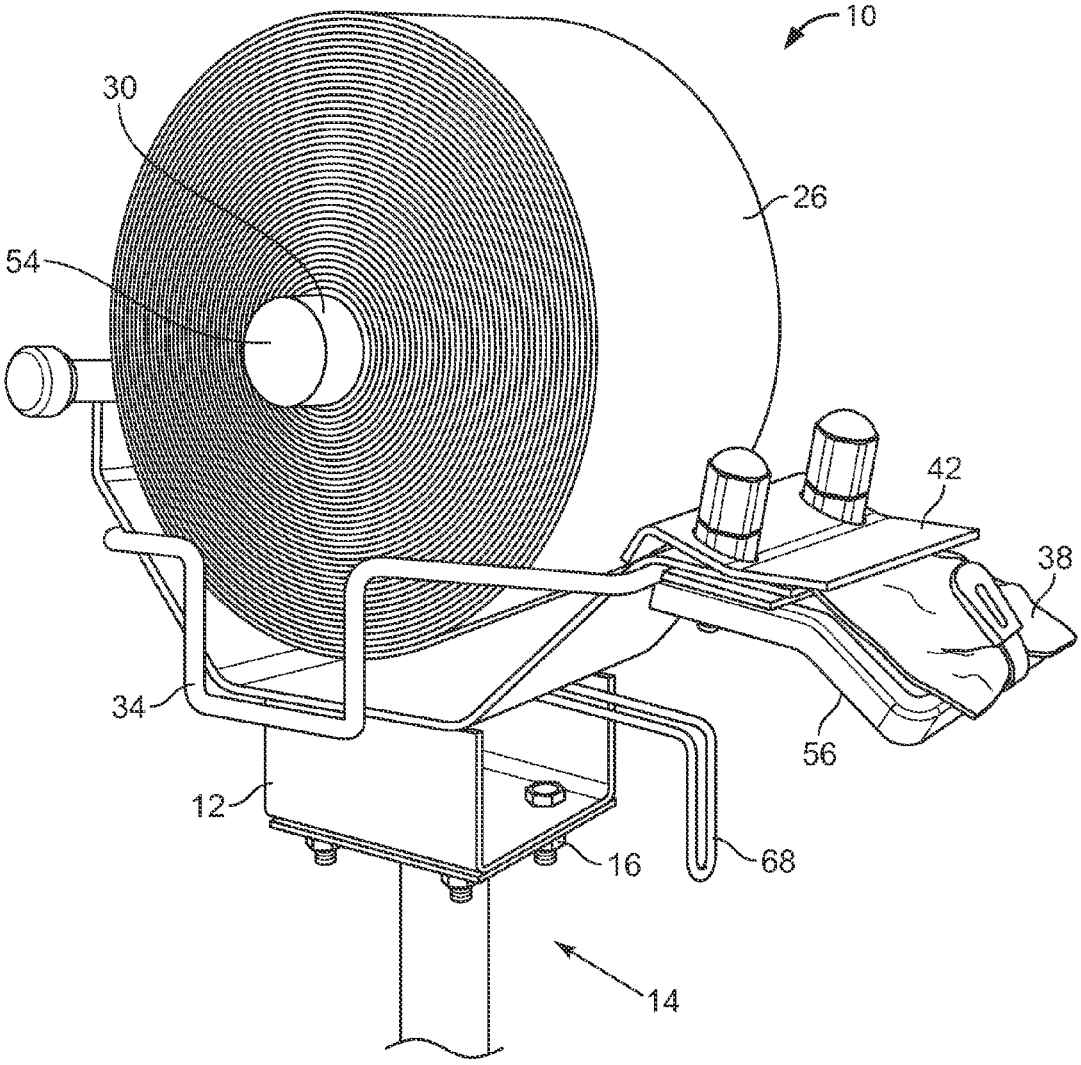
FIG. 1 is a front perspective view of a bag dispenser having features that are examples of inventive aspects in accordance with the present disclosure.
Figure 2:
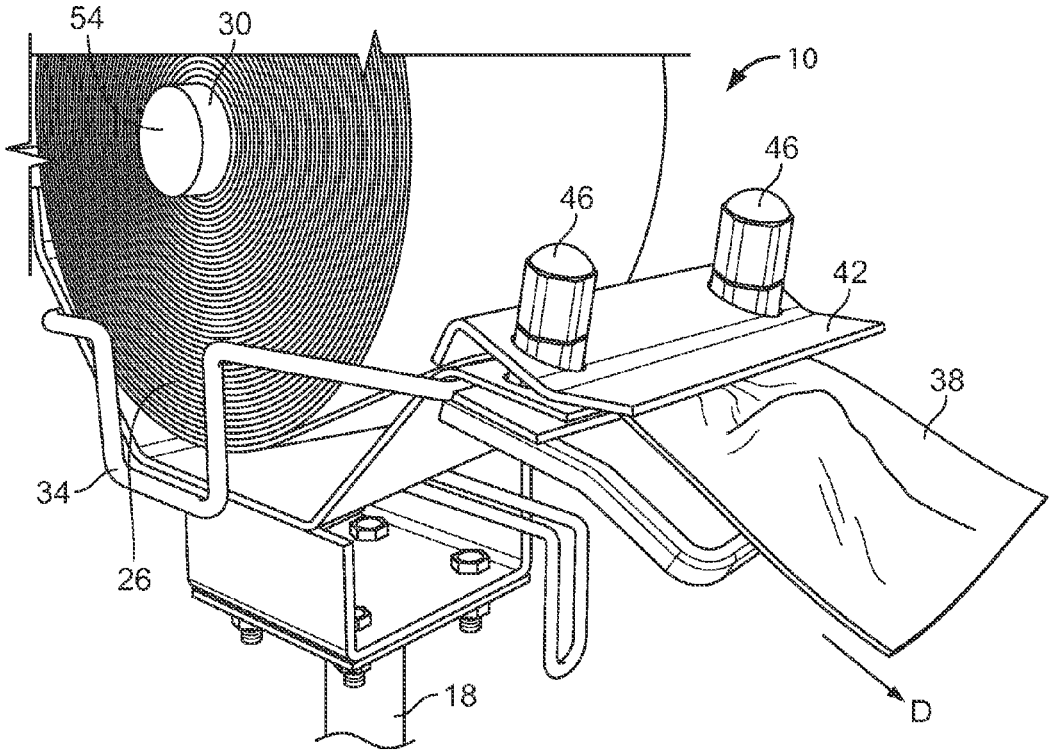
FIG. 2 is another front perspective view of the bag dispenser of FIG. 1.
Figure 3:
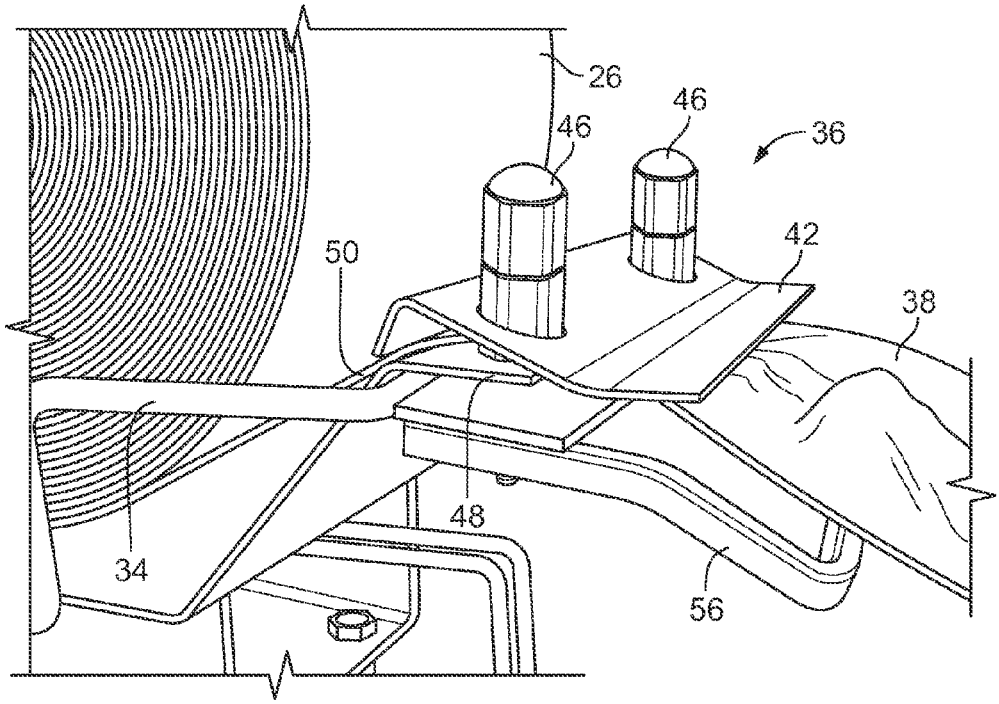
FIG. 3 illustrates a close-up view of the first braking arrangement including the braking plate of the bag dispenser of FIG. 1.
Figure 4:
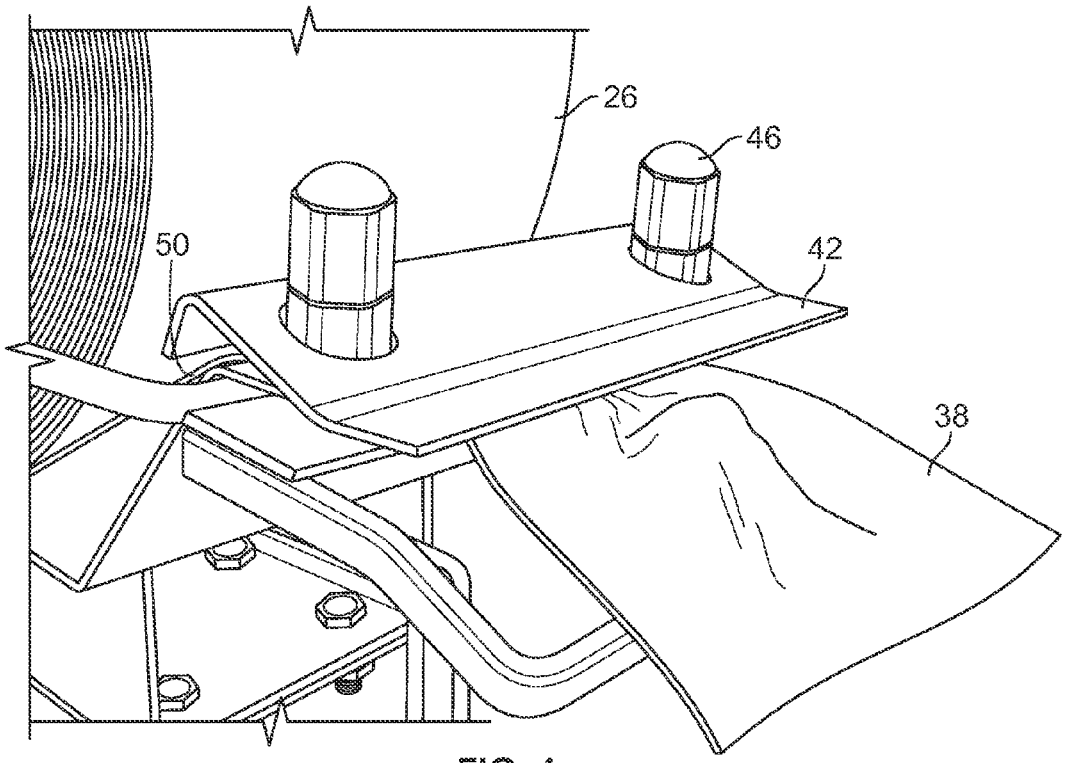
FIG. 4 illustrates another close-up view of the braking plate of FIG. 3 and of the tongue structure of the bag dispenser of FIG. 1.

Reference will now be made in detail to exemplary aspects of the present invention which are illustrated in the accompanying drawings. Wherever possible, the same reference numbers will be used throughout the drawings to refer to the same or similar parts.

FIGS. 1-9 illustrate a bag dispenser 10 having features that are examples of inventive aspects in accordance with the present disclosure. According to one example embodiment, the bag dispenser 10 is generally configured to be used by consumers in stores such as grocery stores for bagging items such as produce, confectionary, etc. The bag dispenser 10 illustrated in FIGS. 1-9 is configured to be a type of bag dispenser, wherein the dispenser is configured or easily configurable to be able to be used with bags made by various different manufacturers as will be discussed below in further detail.

Referring to FIGS. 1-9, the bag dispenser 10 includes a frame 12 that is mounted on a dispenser support 14. The frame 12 of the bag dispenser 10 may be removably mounted to the dispenser support 14 via fasteners 16. The dispenser support 14 may include a base for attaching the dispenser to a ground surface such as in a store. According to one example embodiment, the dispenser support 14 might include a base post attached to the base, a head post 18 to which the frame 12 is mounted, and an intermediate post 20 that is positioned between the base post and the head post 18 that allows adjustability of the height of the frame 12 with respect to the base. The height-adjustability may be provided by holes provided on the intermediate post 20 and spring loaded pins 22 provided on both the base post and the head post 18. The spring loaded pins 22 snap-in to the holes on the intermediate post 20 for locking the frame 12 of the bag dispenser 10 at discrete locking positions to provide for different heights.

The bag dispenser 10 includes a roller 24 for mounting a bag roll 26. According to the depicted embodiment, the roller 24 is attached to the frame 12 with a support arm 28. The roller 24 is stationary with respect to the frame 12 and generally includes a circular configuration to allow the core 30 of the bag roll 26 to rotate during dispensing. The roller 24 and the support arm 28 are positioned and spaced within the frame 12 such that even a full bag roll 26 can rotate on the roller 24 without any portion of the frame 12 contacting the bottom surface 32 of the bag roll 26.

According to the embodiment depicted in FIGS. 1-9, the support arm 28 may be a pivot arm that allows the roller 24 to be pivoted upwardly for replacement of the bag roll 26. The frame 12 includes a containment arrangement defining rails/guards 34 for preventing the bag roll 26 from sliding off the roller 24 once the bag roll 26 is slidably placed on the roller 24. The pivot arm 28 allows the roller 24 to be pivoted upwardly in order for the bag roll 26 to clear the rails 34 during loading of the bag roll 26.

Even though in the embodiment depicted in FIGS. 1-9, the pivot arm 28 is configured to allow the roller 24 to pivot along a plane parallel to the dispending direction D (clockwise/counterclockwise when looking in the direction of the longitudinal axis of the core), it should be noted that in other embodiments, the roller 24 might be pivotally attached to the arm 28 such that the roller 24 pivots with respect to the arm 28 and along a plane that is perpendicular to the dispensing direction D (clockwise/counterclockwise when looking in the dispensing direction, at the front of the bag roll). As will be discussed in further detail below, other arrangements may be used to prevent the bag roll 26 from sliding off the roller 24 once the bag roll 26 is placed on the roller 24.

The bag dispenser 10 includes a first braking arrangement 36 for providing frictional force on the leading bag 38 when a consumer pulls the leading bag 38 to facilitate tearing of the bag 38 at a tear line. The bag dispenser 10 also includes a second braking arrangement 40 to reduce the rotational speed of the bag roll 26 to prevent freewheeling of the bag roll 26 after a consumer pulls and tears the leading bag 38.

Both the first and the second braking arrangements 36, 40 are the types of arrangements that accommodate bag rolls 26 of different manufacturers, for example, bag rolls that might include a different bag thickness/material, a different core diameter, a different weight, etc.

Figure 11:
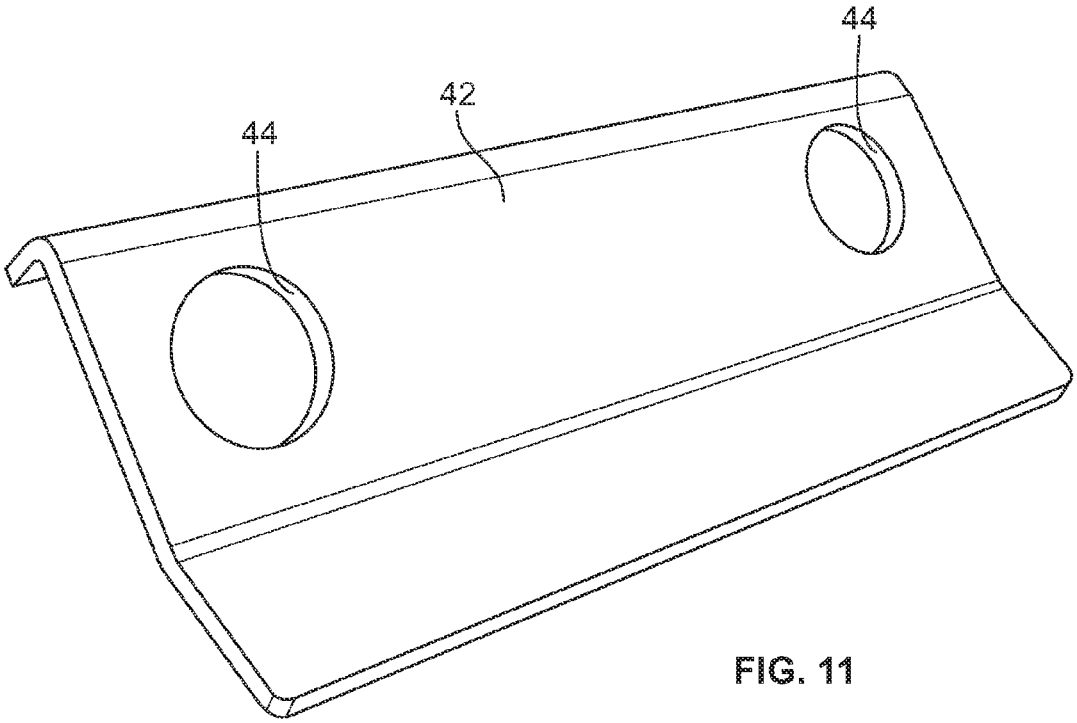
FIG. 11 illustrates the braking plate of the bag dispenser of FIG. 1 in isolation.

The first braking arrangement 36 includes a removable braking plate 42 that includes two openings 44 for slidably mounting the plate 42 through two posts 46 located adjacent the front of the frame 12. The braking plate 42 is shown in isolation in FIG. 11. The braking plate 42 is made removable such that regardless of the type or weight of bag used, the plate 42 can be easily removed and interchanged with a different one to provide the necessary frictional force on the leading bag 38 to facilitate tearing of the bag 38.

In the depicted embodiment, the braking plate 42 cooperates with a braking surface 48 to provide at least one point of contact 50 therebetween for the application of friction. The braking plate 42, even though heavy enough to apply a frictional force to the bag, is also able to move up and down and float via its mounting arrangement to allow for variations in the bag texture and/or thickness.

As noted above, the second braking arrangement 40 is of the type that may be used with a variety of different bag rolls 26 having a variety of different core diameters. According to the embodiment depicted in FIGS. 1-9, the roller 24 includes a surface 52 that provides friction to the internal surface 54 of the core 30 of the bag roll 26. The friction surface 52 of the roller 24 might be provided in different ways, for example, using surface texturing, using a material of relative high static and kinetic coefficient of friction, using an adhesive material to provide a tacky surface, etc. With the application of enough friction, once the leading bag 38 is torn off, the rest of the bag roll 26 does not freewheel within the frame 12. Furthermore, the friction surface 52 provided by the roller 24 allows the roller 24 to be a smaller size than the core 30, allowing the second braking arrangement 40 to be a braking arrangement that can be used with bag rolls 26 having different core diameters. With the cooperation of the first braking arrangement 36 provided by the removable plate 42, the second braking arrangement 40 allows for any variation in the weight, type, material, thickness, tear line configuration, and core diameter of a given bag roll 26.

Even though a roller 24 having a friction surface 52 is used in the embodiment depicted in FIGS. 1-9, in other embodiments, as will be discussed in further detail below, other types of arrangements may be used to prevent freewheeling of the bag roll 26 after dispensing of the leading bag 38.

Figure 5:
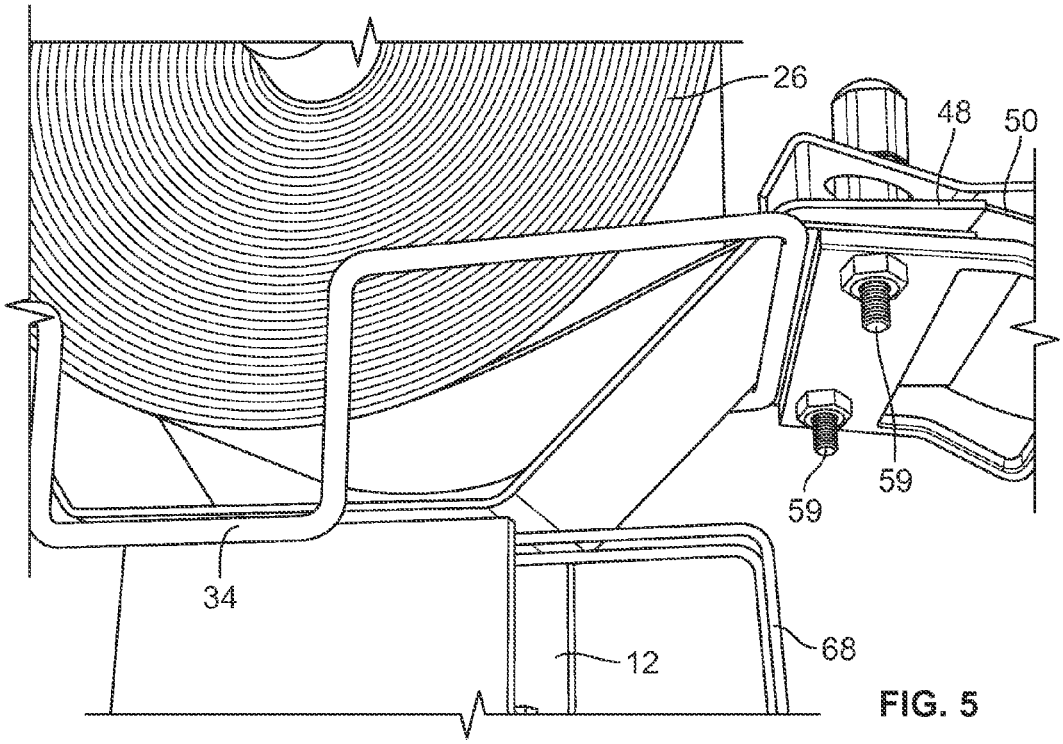
FIG. 5 is a bottom perspective view of the bag dispenser of FIG. 1, illustrating the fasteners used to mount the tongue structure of the bag dispenser.
Figure 6:
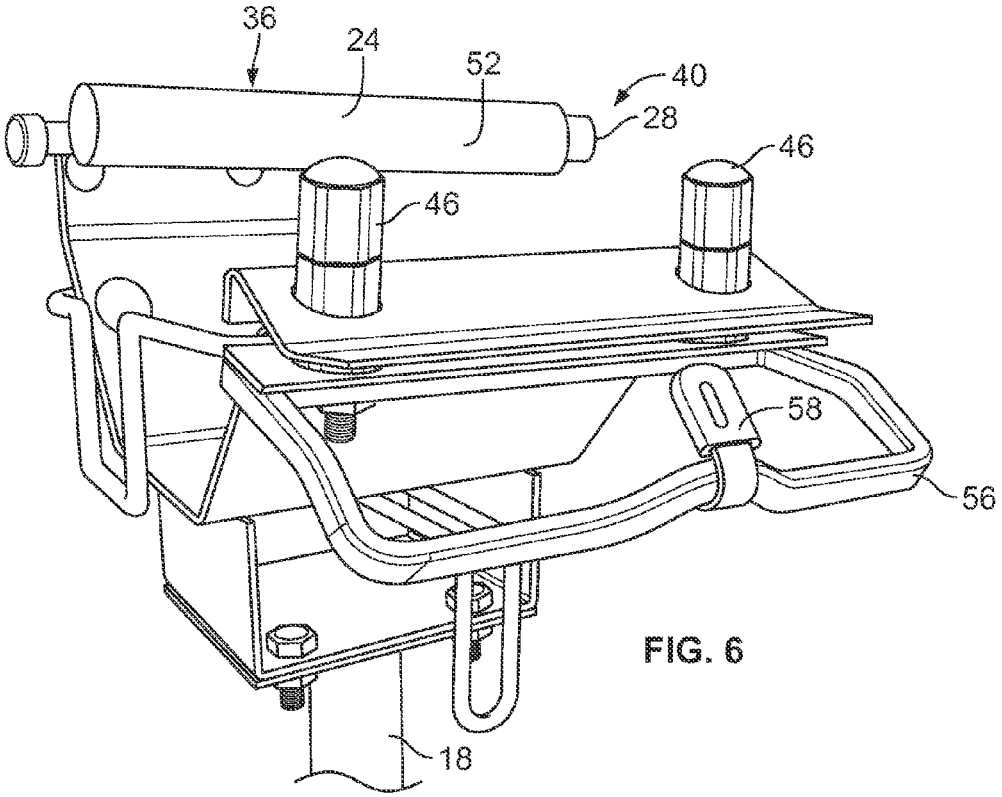
FIG. 6 illustrates a front perspective view of the bag dispenser of FIG. 1 with the bag roll removed from the dispenser.
Figure 7:
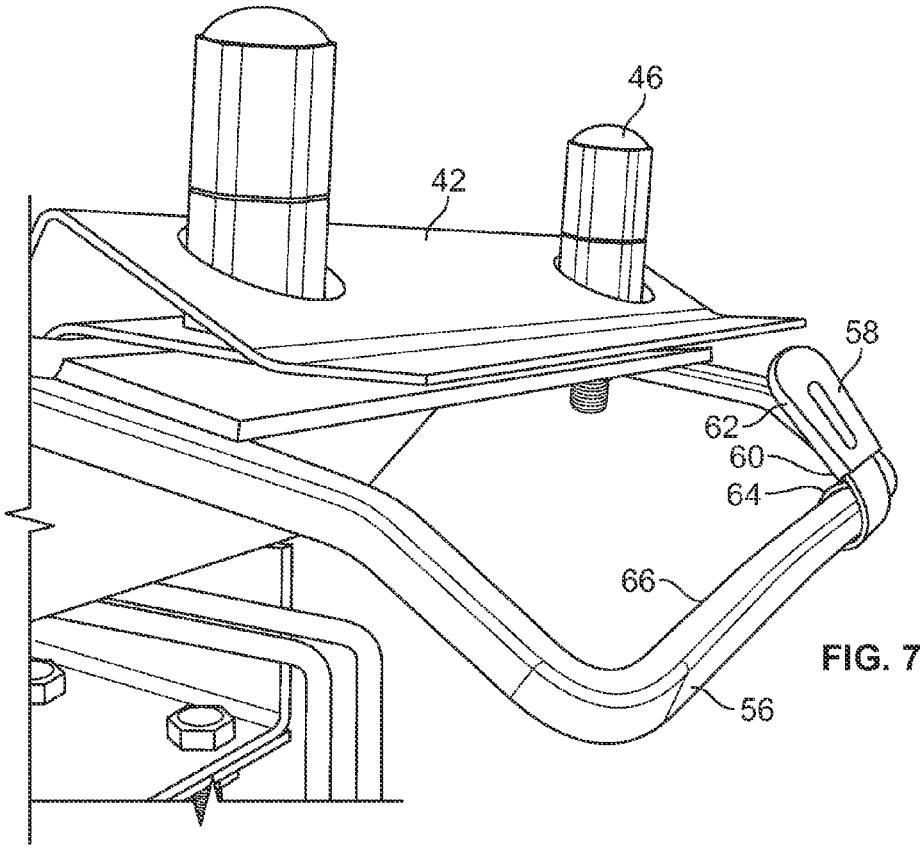
FIG. 7 is a close-up view of the braking plate and the tongue structure of the bag dispenser for FIG. 1 with the bag roll removed to illustrate the pincher/perforator of the dispenser.
Figure 8:
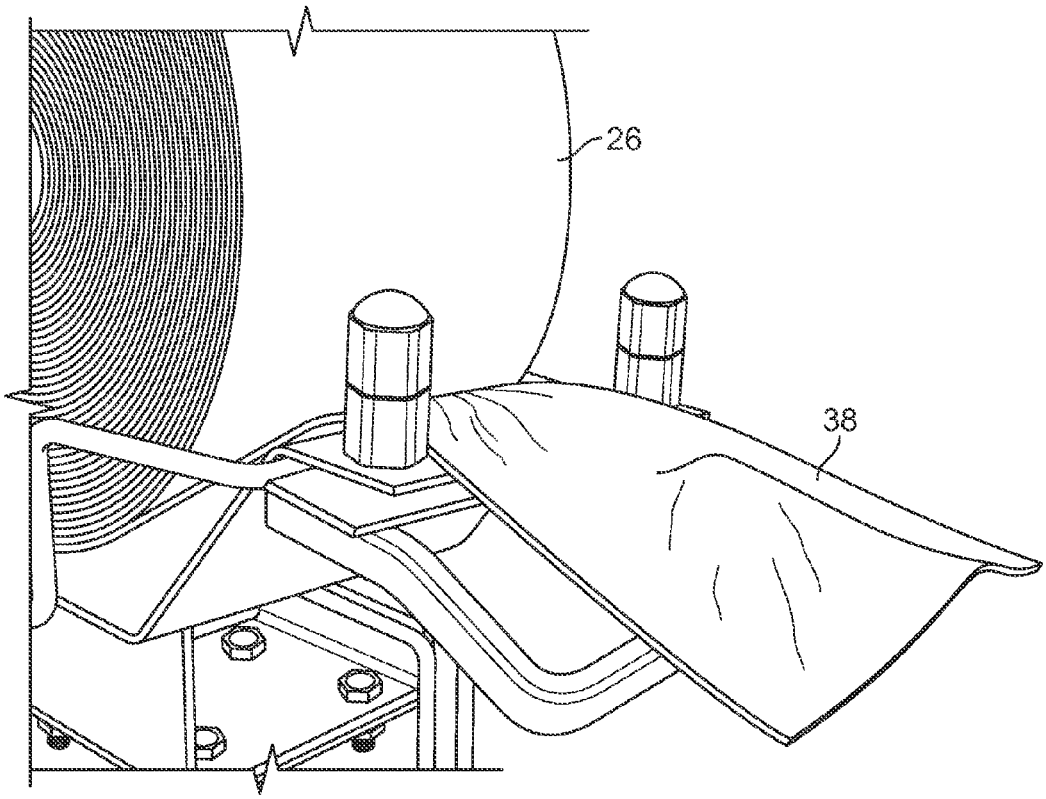
FIG. 8 illustrates the bag dispenser of FIG. 1 with the braking plate removed.
Figure 9:
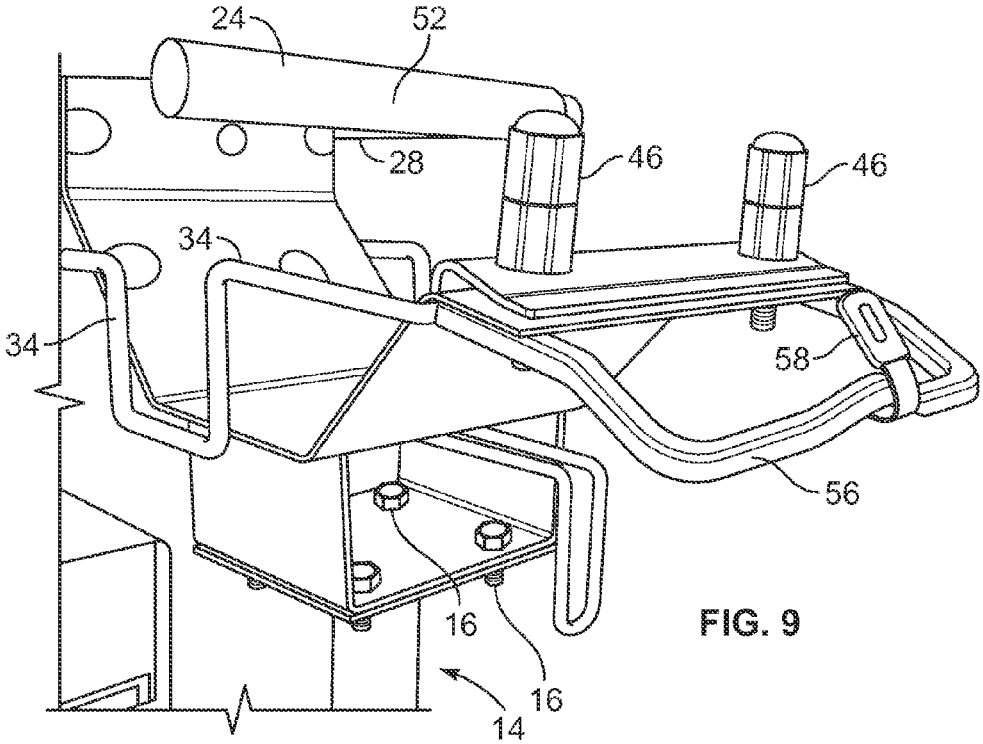
FIG. 9 illustrates the bag dispenser of FIG. 8 with the bag roll removed.

Still referring to FIGS. 1-9, the bag dispenser 10 includes an interchangeable tongue structure 56 that is mounted to the frame 12 with fasteners 59 (as shown in FIG. 5). The tongue structure 56 is mounted to the frame 12 in front of the braking plate 42 and is configured to provide support to the leading bag 38 as the leading bag 38 is being pulled by a consumer. The tongue structure 56 includes a pincher/perforator 58 at the front end for perforating the bag roll 26 and separating the leading bag 38 from the adjacent bag at the tear line. Although different types of pinch points can be designed for catching the adjacent bag after the leading bag 38 has been torn off, in the depicted embodiment, the pinch point 60 is created by the interaction of a flat surface 62 provided by the pincher/perforator 58 and a curved surface 64 provided by a front rail 66 of the tongue structure 56.

The removability and interchangeability of the tongue structure 56 allows for mounting different types and numbers of pinchers/perforators 58 for different manufacturers of bags. For example, if a bag roll includes two perforation points, two perforators 58 might be needed, one at each side at the front of the tongue structure.

Figure 10:
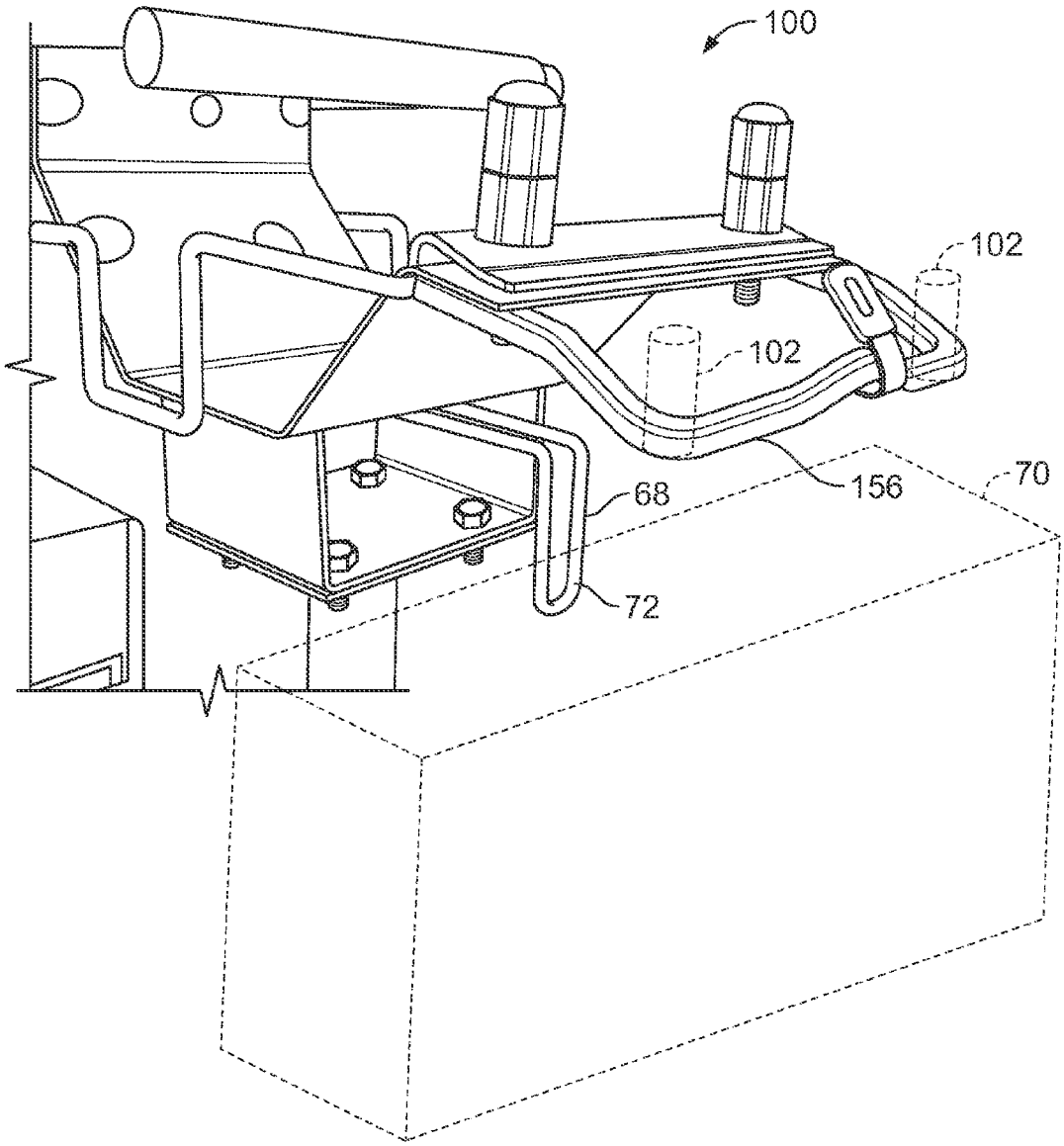
FIG. 10 illustrates a second embodiment of a bag dispenser having features that are examples of inventive aspects in accordance with the present disclosure, the second embodiment similar to the bag dispenser illustrated in FIG. 1 except for the addition of bag pivot contacts, the second embodiment of the bag dispenser shown with an example accessory holder mounted to the accessory mount of the dispenser.
Figure 15:
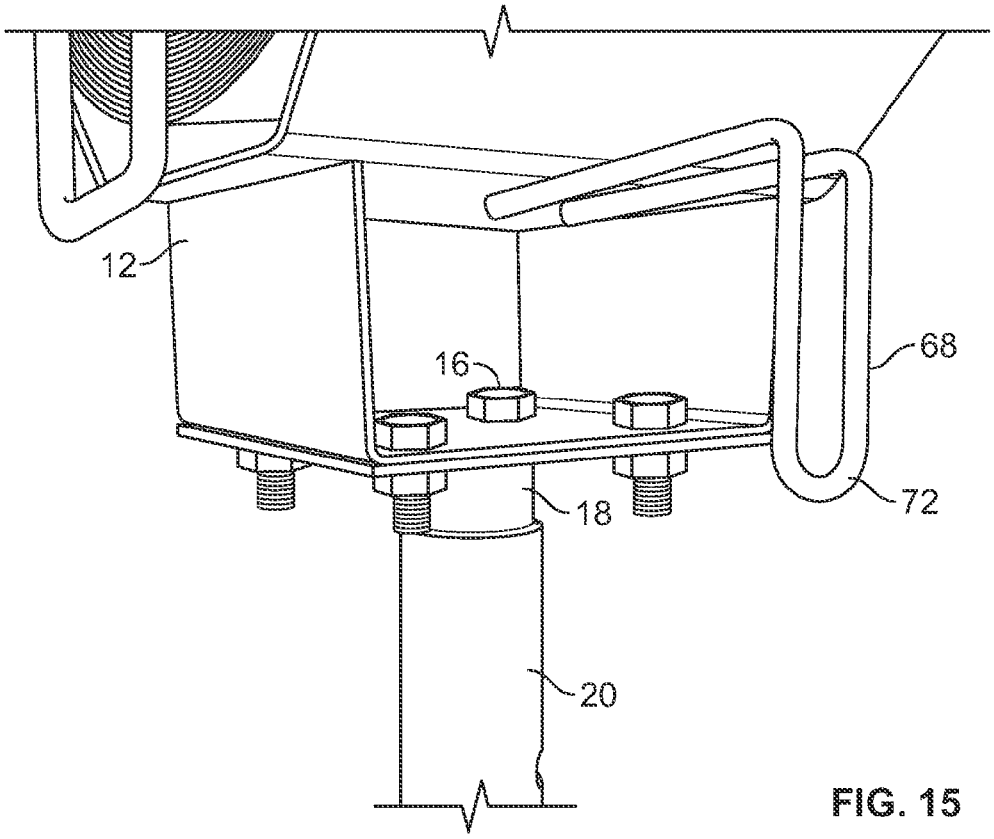
FIG. 15 illustrates a close up view of the accessory mount of the bag dispenser of FIG. 1.

Referring now to FIGS. 10 and 15, the bag dispenser 10 includes an accessory mount 68 for mounting various different types of structures 70 such as twist-tie dispensers or other accessory holders adjacent the bag dispenser 10. The accessory mount 68 can be attached to the frame 12 with mechanical fasteners or other fastening means such as welding, etc. According to the depicted embodiment, the accessory mount defines a U-shaped bracket 72 that can be used, for example, to mount an accessory holder 70 using a nut/bolt/washer fastening arrangement. The U-shaped bracket 72 of the accessory mount 68 also allows other types of accessory holders 70 such as containers or cups to be hung from the accessory mount 68, wherein the accessory holders could hold twist-ties, coupons, etc. An example accessory holder 70 is shown diagrammatically with dotted lines in FIG. 10.

Referring now to FIGS. 10 and 12-14, the dispenser support 14 of the bag dispenser 10 allows the bag dispenser 10 to pivot along a plane generally parallel to a ground surface on which the dispenser support 14 is mounted, allowing a consumer to be able to pull the leading bag 38 of the roll 26 at angles other than parallel to the dispensing direction (dispensing direction indicated by arrow D).

Figure 12:
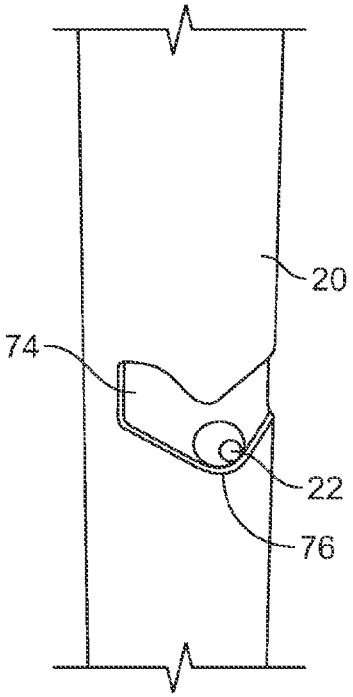
FIG. 12 is a left front perspective view of the dispenser support of the bag dispenser of FIG. 1, illustrating the pivot structure of the bag dispenser.
Figure 13:
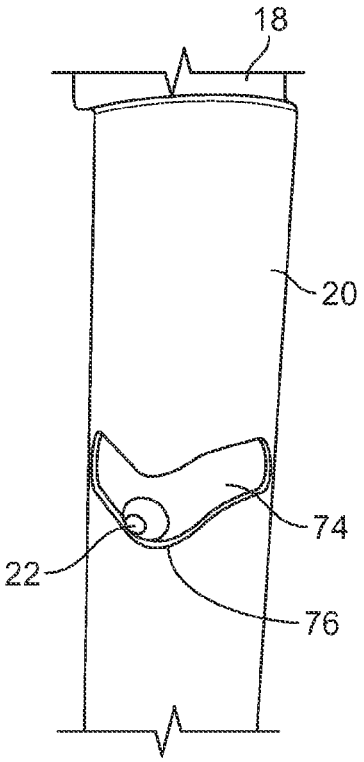
FIG. 13 is a right front perspective view of the pivot structure of FIG. 12.
Figure 14:
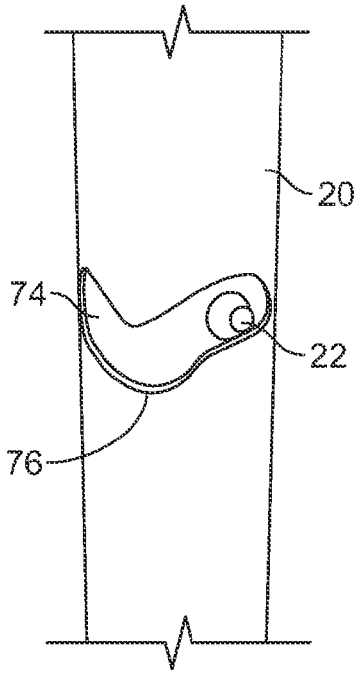
FIG. 14 illustrates the pivot structure when the bag dispenser has been pivoted to the right by a consumer.

In addition to allowing for height adjustment, the intermediate post 20 of the dispenser support 14 may include a pivot groove 74 that interacts with a spring loaded pin 22 of the head post 18 for allowing the frame 12 to be pivoted left to right. According to one embodiment, the pivot groove 74 may be a self-centering groove that includes a generally V-shape or a curved shape as seen in FIGS. 12-14. The shape of the groove 74 guides the pin 22 and uses gravity in allowing the weight of the bag dispenser frame 12 in pivoting the dispenser 10 to the original starting position after a consumer has torn off the leading bag 38. When the bag 38 is torn, the spring loaded pin 22 rides in the groove 74 toward the bottom 76 of the groove 74 to self center the bag dispenser frame 12. In this manner, the stores can maintain a neat appearance with all of the bag dispensers 10 facing in the original dispensing direction. FIGS. 12-13 illustrate the bag dispenser 10 in a non-pivoted or returned-to-original position. FIG. 14 illustrates the pivot structure when the bag dispenser 10 has been pivoted to the right by a consumer.

It should be noted that the groove/pin arrangement is one example method of providing a pivoting and self-centering feature of the bag dispenser 10 and other arrangements may be used to provide for this type of a feature.

Still referring to FIG. 10, in another embodiment of the bag dispenser 100, the tongue 156 may include two bag pivot contact structures 102 depicted as posts. The posts 102 guide the leading bag 38 therebetween and provide a contact surface for the bag 38 if the bag 38 is pulled at an angle other than parallel to the dispensing direction. In this manner, the posts 102 facilitate pivoting of the frame 12 with respect to the dispenser support 14 as shown in FIGS. 12-14 of the application.

As noted above, in the depicted embodiments of the bag dispenser 10, 100, the frame 12 includes a containment arrangement defining rails/guards 34 for preventing the bag roll 26 from sliding off the roller 24 once the bag roll 26 is slidably placed on the roller 24. In the example embodiment, the support arm 28 is a pivot arm that allows the roller 24 to be pivoted upwardly in order for the bag roll 26 to clear the rails 34 during loading of the bag roll 26.

Figure 16:
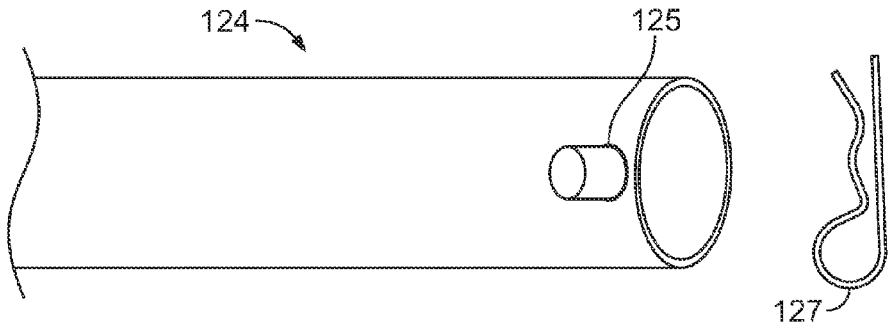
FIG. 16 illustrates a second embodiment of a bag roll containment arrangement for preventing the bag roll from sliding off the roller of the frame of a bag dispenser.

Also as noted above, arrangements other than guards/rails 34 and a pivot arm 28 may be used to prevent the bag roll 26 from sliding off the roller 24 once the bag roll 26 is placed on the roller 24. For example, referring to FIG. 16, a roller 124 defining a throughhole 125 adjacent an end thereof and a clevis pin 127 may be used to keep the bag roll 26 on the frame 12 of the bag dispenser. The clevis pin 127 provides a contact surface perpendicular to the longitudinal axis of the bag roll 26 and keeps the bag roll 26 on the roller 124. It should be noted that a clevis pin 127 is simply one example arrangement and other removable structures that provide such a perpendicular contact surface may be used.

Figure 17:
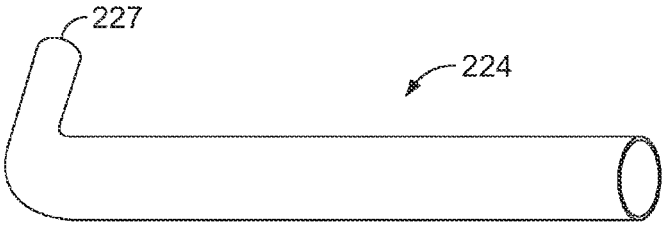
FIG. 17 illustrates a third embodiment of a bag roll containment arrangement for preventing the bag roll from sliding off the roller of the frame of a bag dispenser.

Referring to FIG. 17, a roller 224 defining an upward extension 227 at an end thereof may be used to prevent the bag roll 26 from sliding off the roller 224 once the roll 26 is placed on the roller 224. It should be noted that with the arrangement shown in FIG. 17, the bag roll 26 would have to be tipped or pivoted up to align the core 30 with the extension 227 and then tipped or pivoted down once clearing the extension 227 in placing the bag roll 26 on the roller 224.

Figure 18:
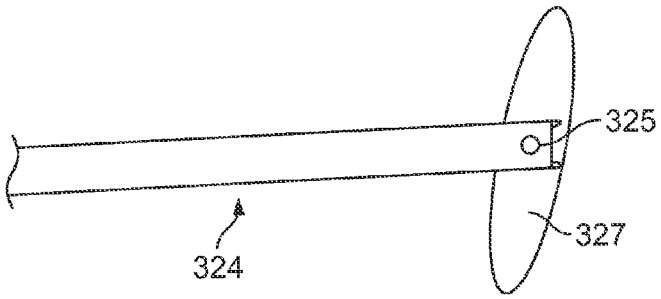
FIG. 18 illustrates a fourth embodiment of a bag roll containment arrangement for preventing the bag roll from sliding off the roller of the frame of a bag dispenser.

Referring now to FIG. 18, a roller 324 having an integral pivoting end piece 327 is shown for preventing the bag roll 26 from sliding off the roller 324 once the roll 26 is placed on the roller 324. The roller 324 may have a groove provided therein with the end piece 327 attached to the end of the roller 324 with a pin 325. When the bag roll 26 is to be placed on the roller 324, the end piece 327 is pivoted to fit within the groove and aligned longitudinally with the roller 324 to allow the bag roll 26 to slide on. After the bag roll 26 is placed on the roller 324, the end piece 327 can be pivoted to a position where it provides a contact surface perpendicular to the longitudinal axis of the roller 324. In certain embodiments, the end piece can 327 be weighted in an offset manner or provided with a biasing mechanism to pivot automatically to a vertical position after the placement of the bag roll 26.

Figure 19:
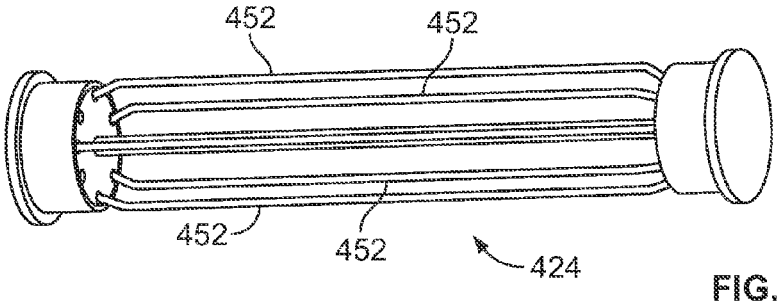
FIG. 19 illustrates a second embodiment of a braking arrangement to prevent freewheeling of the bag roll when a consumer pulls and tears the leading bag.
Figure 20:
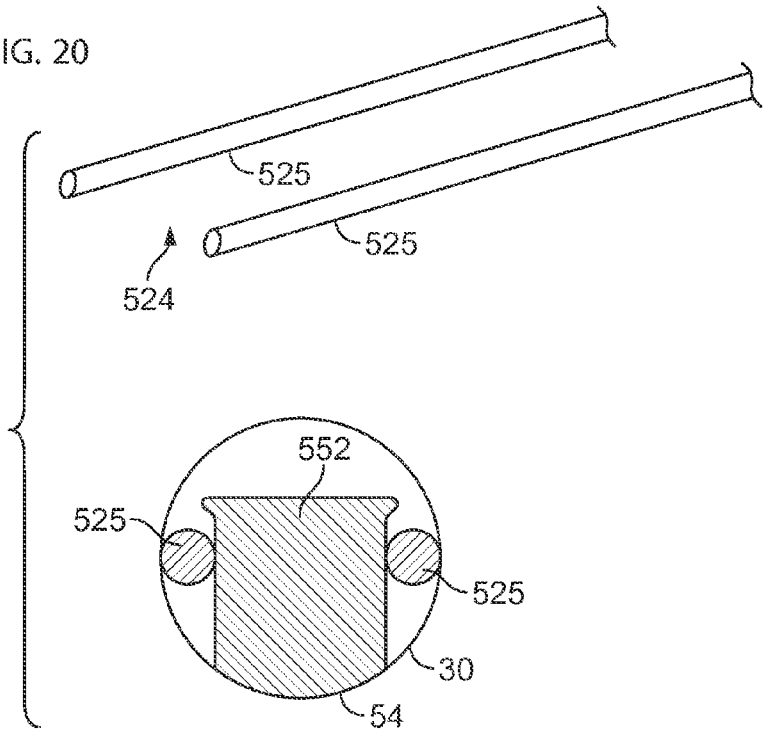
FIG. 20 illustrates a third embodiment of a braking arrangement to prevent freewheeling of the bag roll when a consumer pulls and tears the leading bag.
Figure 21:
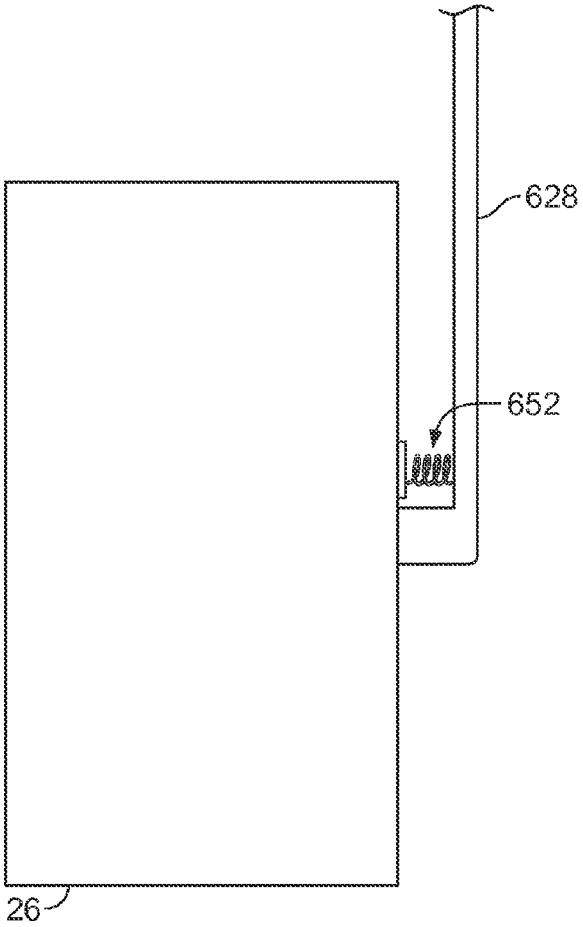
FIG. 21 illustrates a fourth embodiment of a braking arrangement to prevent freewheeling of the bag roll when a consumer pulls and tears the leading bag.

Now referring to FIGS. 19-21, as noted above, the second braking arrangement 40 of the bag dispenser 10 is of the type that may be used with a variety of different bag rolls having a variety of different core diameters. According to the embodiment depicted in FIGS. 1-9, the roller 24 includes a surface 52 that provides friction to the internal surface 54 of the core 30 of the bag roll 26. As noted previously, the friction surface 52 of the roller 24 might be provided in different ways, for example, using surface texturing, using a material of relative high static and kinetic coefficient of friction, using an adhesive material to provide a tacky surface, etc. With the application of enough friction, once the leading bag 38 is torn off, the rest of the bag roll 26 does not freewheel within the frame 12.

As also noted above, arrangements other than a roller 24 having a friction surface 52 may be used to reduce the rotational speed of the core 30 and to prevent freewheeling of the bag roll 26 after dispensing of the leading bag 38. For example, according to an example embodiment shown in FIG. 19, a roller 424 defining a plurality of circumferentially positioned springs 452 can be used. The springs 452 would apply a frictional force in a direction radially outwardly from the longitudinal axis of the roller 424 to slow down the core 30. It should be noted that any number of springs 452 may be used, as long as the springs 452 are provide a frictional force on the inner surface 54 of the core 30. With this arrangement, the roller 424 may still be a type of roller that can accommodate a variety of different bag rolls having a variety of different core diameters.

FIG. 20 illustrates an arrangement wherein the roller 524 would include a pair of rods 525 that would define the main axle for allowing the core 30 of the bag roll 26 to rotate. The rods 525 may be interconnected at their ends through a U-shaped end piece (not shown). A weight piece 552 that is slidable in the up/down direction mounted on the rods 525 would provide the frictional force needed to slow down the bag roll 26. The weight piece 552 would be able to slide downwardly until contacting the bottom interior surface 54 of the core 30. Since the weight piece 552 is free to slide up and down with respect to the rods 525, with this kind of an arrangement, regardless of the relative size difference between the axle formed by the rods 525 and the core inner diameter, the weight piece 552 would take up the slack between the two diameters and provide the necessary friction on the bottom of the core interior surface 54. And, thus, the roller 524 would still be a type of roller that can accommodate a variety of different bag rolls having a variety of different core diameters.

FIG. 21 illustrates another arrangement for reducing the rotational speed of the core 30 of the bag roll 26 and preventing freewheeling of the bag roll 26 after dispensing no matter what the size of the core 30 is. In the arrangement illustrated in FIG. 21, a biasing member 652 located at some portion on the frame 12 (between the support arm 628 and the edge of the bag roll 26 in the depicted embodiment) would slow down the rotation of the bag roll 26 by applying friction along a direction parallel to the longitudinal axis of the core 30. It should be noted that the depicted example is simply one example arrangement of reducing rotational speed of the core 30 by the application of an external biasing element 652 such as a spring and that other arrangements provided on other locations on the bag dispenser may also be used.

FIGS. 22-26 illustrate another embodiment of bag dispenser 700 having features that are examples of inventive aspects in accordance with the present disclosure. The bag dispenser 700 of FIGS. 22-26 includes features that are similar to the previously described and illustrated embodiments 10, 100 except for a number of differences that will be described herein.

Figure 22:
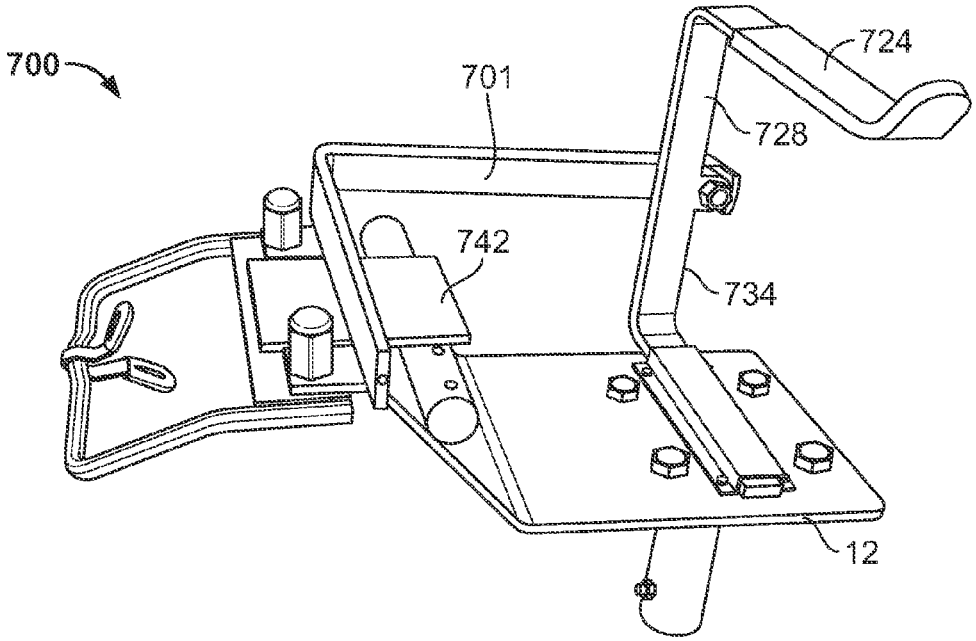
FIG. 22 is a perspective view of a third embodiment of a bag dispenser having features that are examples of inventive aspects in accordance with the present disclosure, the third embodiment of the bag dispenser shown with the braking plate in a non-pivoted orientation.
Figure 23:
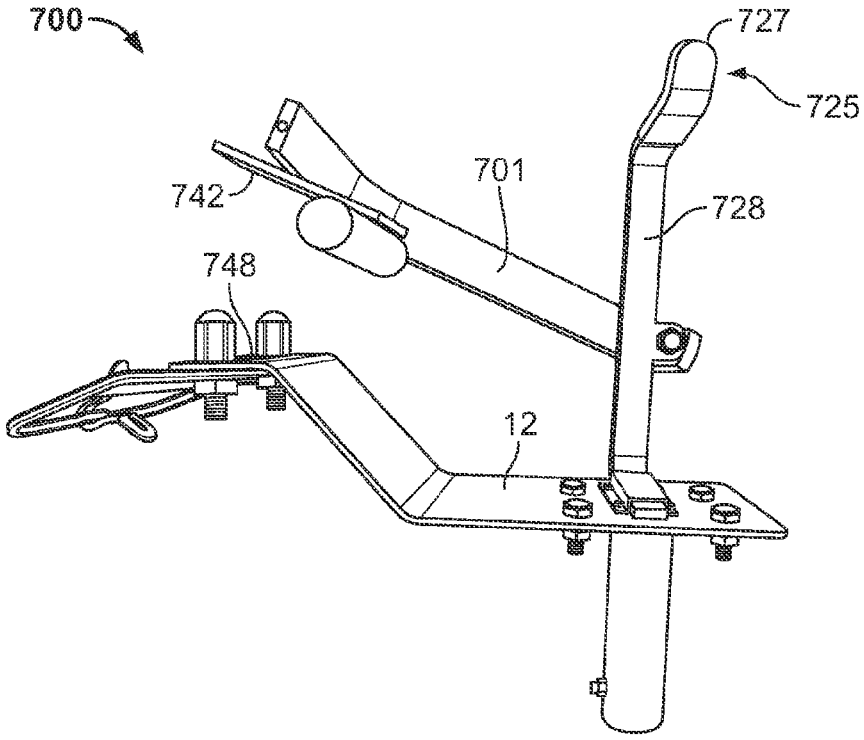
FIG. 23 illustrates the third embodiment of the bag dispenser of FIG. 22 with the braking plate in a pivoted orientation.
Figure 24:
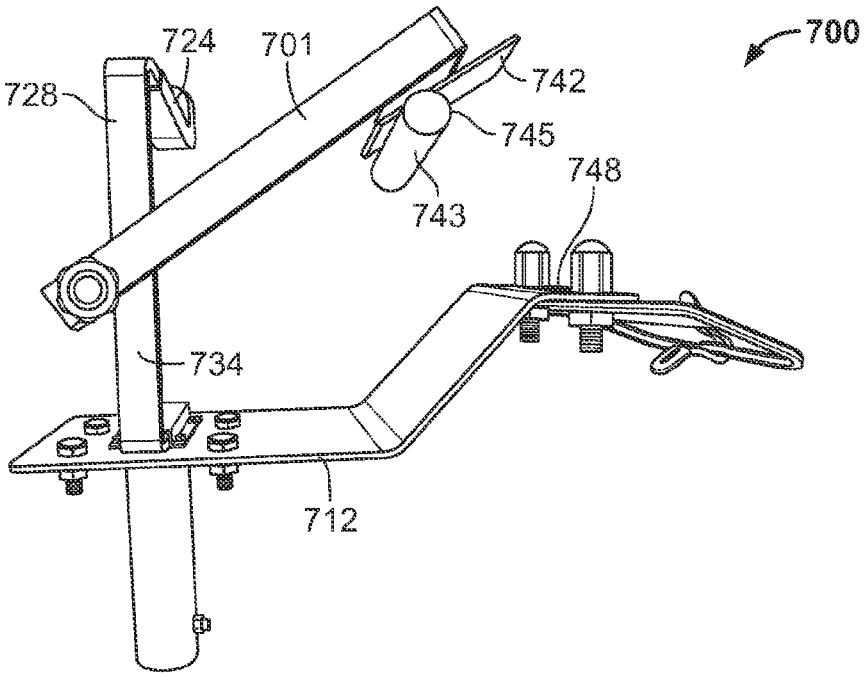
FIG. 24 illustrates another perspective view of the bag dispenser of FIGS. 22-23, with the braking plate in a pivoted orientation.

Referring now specifically to FIGS. 22-24, in the bag dispenser 700, the support arm 728 that attaches the roller 724 to the frame 712 is a vertical structure as opposed to a horizontal structure as in the previous embodiments 10, 100. Also, unlike in the previous embodiments, the support arm 728 of the bag dispenser 700 is fixedly attached to the frame 712 rather than being pivotally arranged as in the previous embodiments 10, 100. The support arm 728 is sized in length such that even a full bag roll 26 can rotate on the roller 724 without any portion of the frame 712 contacting the bottom surface 32 of the bag roll 26. In the embodiment of the bag dispenser 700 shown in FIGS. 22-26, the support arm 728 also acts a containment structure 734 for preventing the bag roll 26 from sliding off the opposite end of the roller 724 once the bag roll 26 has been slidably placed over a loading end 725 of the roller 724.

Further, unlike the previous embodiments of the dispensers 10, 100 discussed above, the bag dispenser 700 defines a first braking arrangement 736 that includes a braking plate 742 that is pivotally mounted to the support arm 728 of the bag dispenser 700 via a pivot arm 701. Unlike the previous embodiments of the bag dispensers 10, 100 wherein the first braking arrangement is defined by a braking plate that is removable for accommodating different types or thicknesses of bags, the floatability of the braking plate 742 of the bag dispenser 700 is provided by the pivoting arrangement. The pivotable braking plate 742 is configured to pivot along a plane parallel to the dispensing direction D. When mounting a bag roll 26 on the dispenser 700, by pivoting the plate 742, a leading bag 38 can be placed underneath the braking plate 742, in between the plate 742 and the frame 712.

Similar to the previous bag dispensers 10, 100, the braking plate 742 cooperates with a braking surface 748 to provide at least one point of contact therebetween for application of friction. The braking plate 742, even though heavy enough to apply a frictional force to the bag 38, is also able to adjust for variations in the bag thickness, texture by being floatable via the pivotable mounting arrangement.

As shown in FIGS. 22-26, the braking plate 742 defines a transition portion 743 that provides a curved contact surface 745 for guiding the leading bag 38 from the bag roll 26 to the area where friction is applied, between the plate 742 and the braking surface 748 of the frame 712. The curved contact surface 745 of the transition portion 743 may also provide additional friction to the leading bag 38 as the leading bag 38 is being pulled while allowing the leading bag 38 to be able to smoothly slide and be unrolled from the bag roll 26.

Even though the bag dispenser 700 of FIGS. 22-26 has been depicted with a number of features that were noted for the previously described bag dispensers 10, 100 such as a removable tongue structure with a pincher/perforator, it should be noted that the dispenser 700 of FIGS. 22-26 may include any of the other features that have been described for the above dispensers of FIGS. 1-21, such as an accessory mount and/or different types of universal second braking arrangements.

Figure 25:
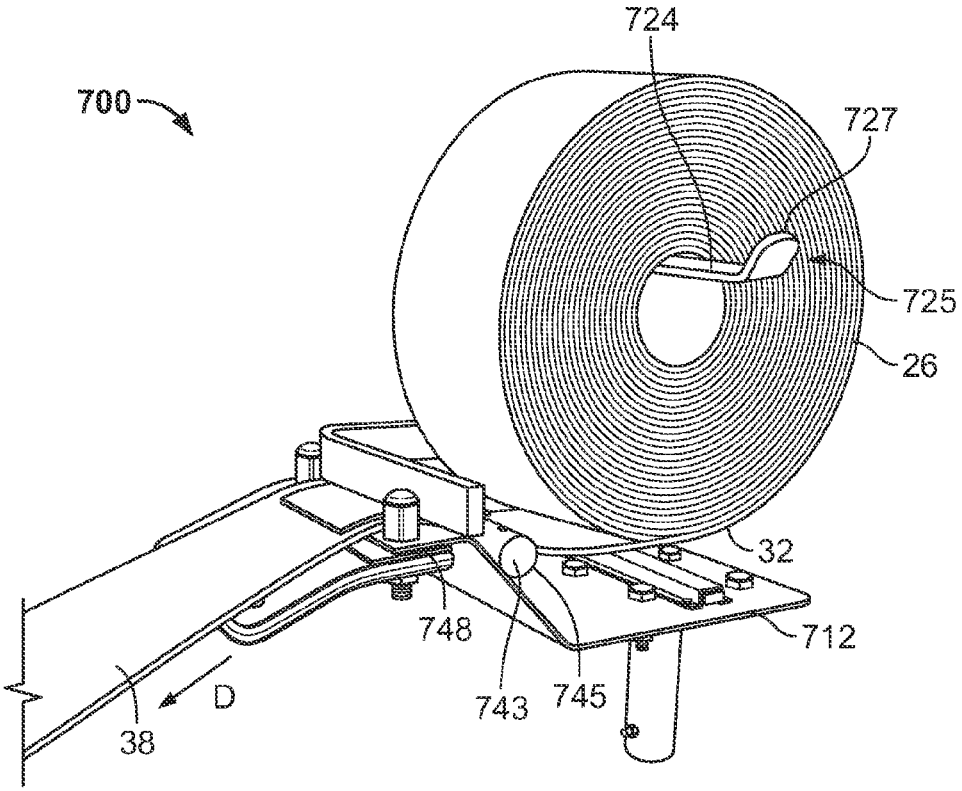
FIG. 25 illustrates the bag dispenser of FIGS. 22-24 with a bag roll mounted thereon, the bag dispenser shown with the braking plate in a non-pivoted orientation.
Figure 26:
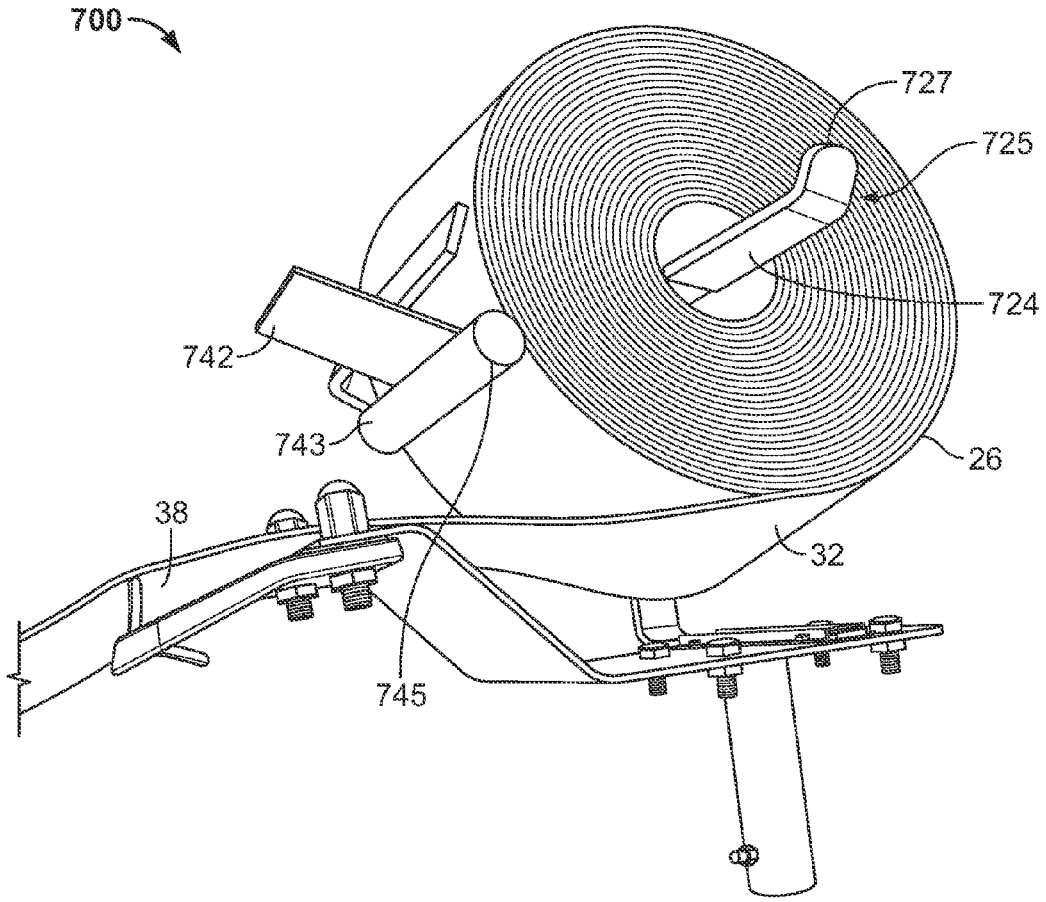
FIG. 26 illustrates the bag dispenser and the bag roll of FIG. 25 with the braking plate in a pivoted orientation.

For example, referring now to FIGS. 25-26, even though the bag dispenser 700 has been depicted with a roller 724 that is similar in structure to the roller 224 shown in FIG. 17, the bag dispenser 700 may include any of the above-discussed structures for mounting the bag roll 26 to the dispenser 700 and/or for braking arrangements for preventing freewheeling of the bag roll 26 after dispensing of the leading bags 38.

Similar to the roller 224 shown in FIG. 17, the roller 724 of the bag dispenser 700 defines an upward extension 727 at a loading end 725 thereof for preventing the bag roll 26 from sliding off the roller 724 once the bag roll 26 is placed on the roller 724. As discussed with respect to the roller 224 of FIG. 17, with the roller 724 used on the bag dispenser 700 of FIGS. 22-26, the bag roll 26 may have to be tipped or pivoted up in placing the bag roll 26 over the loading end 725 and then tipped or pivoted down once clearing the extension 727 in placing the bag roll 26 on the roller 724.

Although in the foregoing description, terms such as "top", "bottom", "front", "back", "right", "left", "upper", and "lower were used for ease of description and illustration, no restriction is intended by such use of the terms. The dispensers described herein can be used in other orientations, depending upon the desired application.

The above specification, examples and data provide a description of the configuration and use of the devices therein. However, many embodiments of the disclosure can be made without departing from the spirit and scope of the inventive aspects.

The invention claimed is:

1. A bag dispenser comprising:

a frame including a roller portion for receiving a bag roll defined by a plurality of bags attached to a leading bag to be dispensed, the roller defining a longitudinal axis; and a dispenser support for mounting the frame on a mounting surface, the dispenser support defining a base configured to be mounted to the mounting surface, a first post attached to the base and a second post attached to the frame, the second post being at least partially rotatable with respect to the first post for allowing the frame to pivot with respect to the mounting surface along a plane including the longitudinal axis of the roller, one of the first post and the second post defining a generally V-shaped self-centering groove configured to receive a pin of the other of the first post and the second post.

2. A bag dispenser according to claim 1, further comprising a bag roll mounted to the roller portion of the frame.

3. A bag dispenser according to claim 1, wherein the roller portion of the frame is fixedly coupled to the frame and is configured to allow a cylindrical core of the bag roll to rotate therearound for dispensing of the bags.

4. A bag dispenser according to claim 1, further including a perforator for separating the leading bag from the plurality of bags of the bag roll, the perforator removably attached to the frame.

5. A bag dispenser according to claim 1, further comprising an accessory mount for mounting an accessory holder to the bag dispenser.

6. A bag dispenser according to claim 1, wherein the frame is removably mounted to the dispenser support.

7. A bag dispenser according to claim 1, wherein the first post is an intermediate post extending between the second post that is attached to the frame and a third post that is attached to the base.

8. A bag dispenser according to claim 1, wherein the dispenser support is configured to allow height-adjustability for the bag dispenser with respect to the mounting surface.

9. A bag dispenser according to claim 1, further comprising a brake plate configured to capture the leading bag against the frame for providing frictional force on the leading bag to limit sliding thereof, the brake plate movably attached to the frame.

10. A bag dispenser comprising:

a frame removably mounted on a dispenser support, the dispenser support configured for mounting the frame on a mounting surface, the frame including a roller portion for receiving a bag roll defined by a plurality of bags attached to a leading bag to be dispensed, the roller defining a longitudinal axis; and a brake plate configured to capture the leading bag against the frame for providing frictional force on the leading bag to limit sliding thereof, the brake plate pivotally attached to the frame via a pivot arm, the brake plate pivotable with respect to the frame between a non-pivoted friction-application position and a pivoted bag roll installment position, the pivot arm configured to pivot with respect to the frame along a pivot plane generally perpendicular to the longitudinal axis;

wherein the dispenser support defines a base configured to be mounted to the mounting surface, a base post attached to the base, a head post attached to the frame, and an intermediate post extending between the base post and the head post, the intermediate post rotatable with respect to the head post, wherein one of the intermediate post and the head post defines a generally V-shaped self-centering groove configured to receive a spring-loaded pin extending outwardly from the other of the intermediate post and the head post.

11. A bag dispenser according to claim 10, further comprising a bag roll mounted to the roller portion of the frame.

12. A bag dispenser according to claim 10, wherein the roller portion of the frame is fixedly coupled to the frame and is configured to allow a cylindrical core of the bag roll to rotate therearound for dispensing of the bags.

13. A bag dispenser according to claim 10, further including a perforator for separating the leading bag from the plurality of bags of the bag roll, the perforator removably attached to the frame.

14. A bag dispenser according to claim 10, further comprising an accessory mount for mounting an accessory holder to the bag dispenser.

15. A bag dispenser according to claim 10, wherein the dispenser support is configured to allow height-adjustability for the frame with respect to the mounting surface.

16. A bag dispenser according to claim 10, wherein the dispenser support is configured to allow pivotability of the frame with respect to the mounting surface along a plane generally perpendicular to the pivot plane of the brake plate.

* * * * *